US009831577B2

(12) United States Patent
Fujii et al.

(10) Patent No.: US 9,831,577 B2
(45) Date of Patent: Nov. 28, 2017

(54) BOARD CONNECTOR

(71) Applicant: Sumitomo Wiring Systems, Ltd., Yokkaichi, Mie (JP)

(72) Inventors: Masayasu Fujii, Mie (JP); Toshikazu Sakurai, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/297,192

(22) Filed: Oct. 19, 2016

(65) Prior Publication Data

US 2017/0125929 A1 May 4, 2017

(30) Foreign Application Priority Data

Oct. 29, 2015 (JP) ..... 2015-212618

(51) Int. Cl.

| | |
|---|---|
| ***H01R 12/71*** | (2011.01) |
| ***H01R 13/633*** | (2006.01) |
| ***H01R 43/24*** | (2006.01) |
| ***H01R 13/629*** | (2006.01) |
| ***H01R 43/20*** | (2006.01) |

(52) U.S. Cl.

CPC ..... *H01R 12/712* (2013.01); *H01R 13/62933* (2013.01); *H01R 13/6335* (2013.01); *H01R 43/205* (2013.01); *H01R 43/24* (2013.01)

(58) Field of Classification Search

CPC ..... H01R 13/62938; H01R 13/631; H01R 13/62955; H01R 13/629

USPC ..... 439/157, 374, 701

See application file for complete search history.

(56) References Cited

U.S. PATENT DOCUMENTS

| | | | | | |
|---|---|---|---|---|---|
| 5,161,996 | A * | 11/1992 | Locati | H01R 12/7011 | 439/374 |
| 5,655,914 | A * | 8/1997 | McCartin | H01R 12/57 | 439/374 |
| 5,697,805 | A * | 12/1997 | Orstad | H01R 13/6315 | 439/374 |
| 6,146,184 | A * | 11/2000 | Wilson | H01R 12/7005 | 439/248 |
| 6,767,239 | B2 * | 7/2004 | Fukamachi | H01R 13/6456 | 439/374 |
| 2003/0109167 | A1 * | 6/2003 | Maegawa | H01R 13/62933 | 439/374 |

FOREIGN PATENT DOCUMENTS

JP 2012-146445 8/2012

* cited by examiner

*Primary Examiner* — Gary Paumen

(74) *Attorney, Agent, or Firm* — Gerald E. Hespos; Michael J. Porco; Matthew T. Hespos

(57) ABSTRACT

A board connector (M) includes a housing (10) formed from first and second separately formed moldings (11, 12). The first molding (11) includes a terminal holding portion (13) and a base-side peripheral wall (20). The second molding (20) is tubular and includes a tip-side peripheral wall (28) with a supporting shaft (31) and ribs (32) projecting integrally in from an inner surface of the tip-side peripheral wall (28). The base-side peripheral wall (20) and the tip-side peripheral wall (28) are assembled to form a receptacle (14) projecting forward from an outer peripheral edge of the terminal holding portion (13). A supporting shaft (31) and ribs (32) are formed integrally with the receptacle (14) and project from an inner wall surface of the receptacle (14).

10 Claims, 12 Drawing Sheets

BOARD CONNECTOR

BACKGROUND

Field of the Invention

The invention relates to a board connector.

Description of the Related Art

Japanese Unexamined Patent Publication No. 2012-146445 discloses a board connector with a housing and male terminal fittings to be connected to the circuit board. The housing is made of synthetic resin and is configured to be mounted on the circuit board. The housing is formed integrally with a terminal holding portion and the male terminal fittings are held by and penetrate through the holding portion. A receptacle projects forward from the outer peripheral edge of the terminal holding portion. A cam pin projects on an inner wall surface of the receptacle and is to be fit into a cam groove of a lever provided on a mating connector.

The housing can be molded using molds that are opened parallel with a projecting direction of the receptacle. Since the cam pin projects from the inner wall surface of the receptacle, a slide pin is provided in the mold for molding a substantially semicircular region of the outer peripheral surface of the cam pin facing the front surface of the terminal holding portion. The slide pin projects from the mold for molding the back surface of the terminal holding portion to penetrate through the terminal holding portion. Thus, a mold removal hole left by removing the slide pin is formed at a position of the terminal holding portion corresponding to the cam pin.

The invention was completed based on the above situation and aims to eliminate the need for forming a terminal holding portion with a mold removal hole.

SUMMARY

The invention is directed to a board connector with a housing made of synthetic resin and to be mounted on a circuit board. The housing includes a terminal holding portion and at least one terminal fitting is mounted to penetrate through the terminal holding portion for connection to the circuit board. The housing includes a receptacle projecting forward from an outer peripheral edge of the terminal holding portion. At least one protrusion is formed integrally or unitarily to the receptacle and projects from an inner wall surface of the receptacle. The housing is formed form first and second moldings that are formed separately from one another. The first molding defines the terminal holding portion and a base-end-side peripheral wall, and hence a region of the receptacle closer to the terminal holding portion than the protrusion. The second molding is tubular and forms a tip-side peripheral wall portion and the protrusion out of the receptacle.

The protrusion may be a supporting shaft for rotatably or pivotably supporting a lever for exhibiting a boosting function. According to this configuration, the lever can be accommodated in the receptacle.

A projecting end of the base-end-side peripheral wall may be located at the substantially same position as or more forward than the tip of the terminal fitting in a projecting direction of the receptacle from the terminal holding portion as a reference. According to this configuration, the terminal fitting can be protected from interference by external matter in a state before the base-end-side peripheral wall and the tip-side peripheral wall are united.

The first molding and the second molding may be connectable by being press-fitt, and/or the first molding may be formed with at least one board fixing portion for fixing the first molding to the circuit board particularly by at least one fastening member. According to this configuration, it is not necessary to directly fix the second molding and the circuit board.

A tubular fitting may be provided for positioning the base-end-side peripheral wall and the tip-side peripheral wall in a united state.

The invention also relates to a method for producing a board connector. The method may include forming a first molding that includes the terminal holding portion and a base-end-side peripheral wall; forming a tubular second molding that includes a tip-end side of the peripheral wall and a protrusion; and assembling the first and second moldings.

The method may further include mounting at least one terminal fitting in the terminal holding portion.

The protrusion be a supporting shaft for rotatably supporting a lever for exhibiting a boosting function.

The base-end-side peripheral wall may be formed such that a projecting end thereof is located at the substantially same position as or more forward than the tip of the terminal fitting in a projecting direction of the receptacle from the terminal holding portion as a reference.

The method may include connecting the first molding and the second molding by being press-fit together.

The first molding may formed with at least one board fixing portion for fixing the first molding to the circuit board.

The method may further comprise forming a tubular fitting portion capable of positioning the base-end-side peripheral wall and the tip-side peripheral wall in a united state.

The housing is configured by molding the first and second moldings in separate steps and assembling the moldings already molded. In an assembled state, the base-end-side peripheral wall and the tip-side peripheral wall are united to configure the receptacle. The protrusion is formed not on the first molding, but on the second molding. Thus, it is not necessary to form the terminal holding portion with a mold removal hole left in molding the protrusion.

These and other features of the invention will become more apparent upon reading the following detailed description and accompanying drawings. It should be understood that even though embodiments are described separately, single features thereof may be combined to additional embodiments.

DETAILED DESCRIPTION

Figure 8:
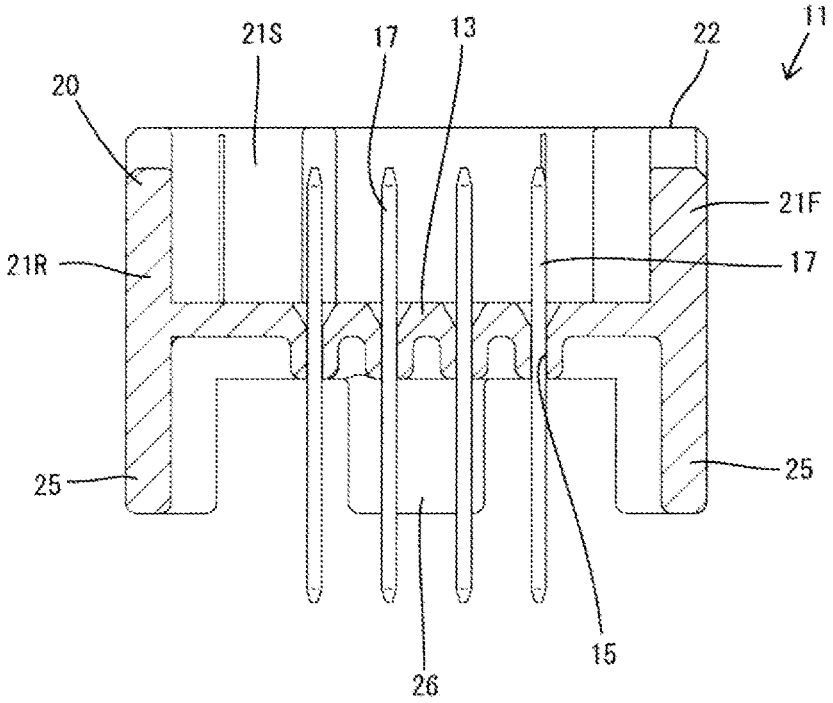
FIG. 8 is a section along C-C of FIG. 6.
Figure 9:
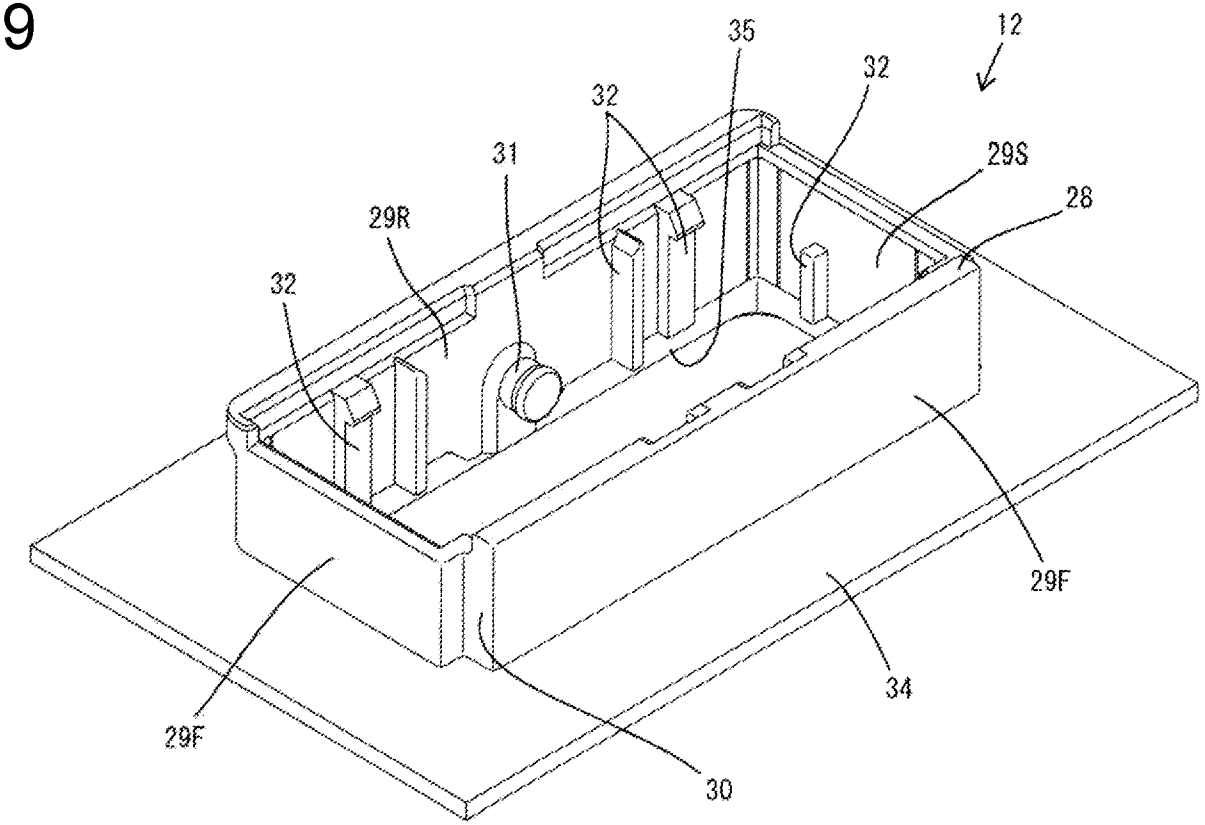
FIG. 9 is a perspective view of a second molding
Figure 10:
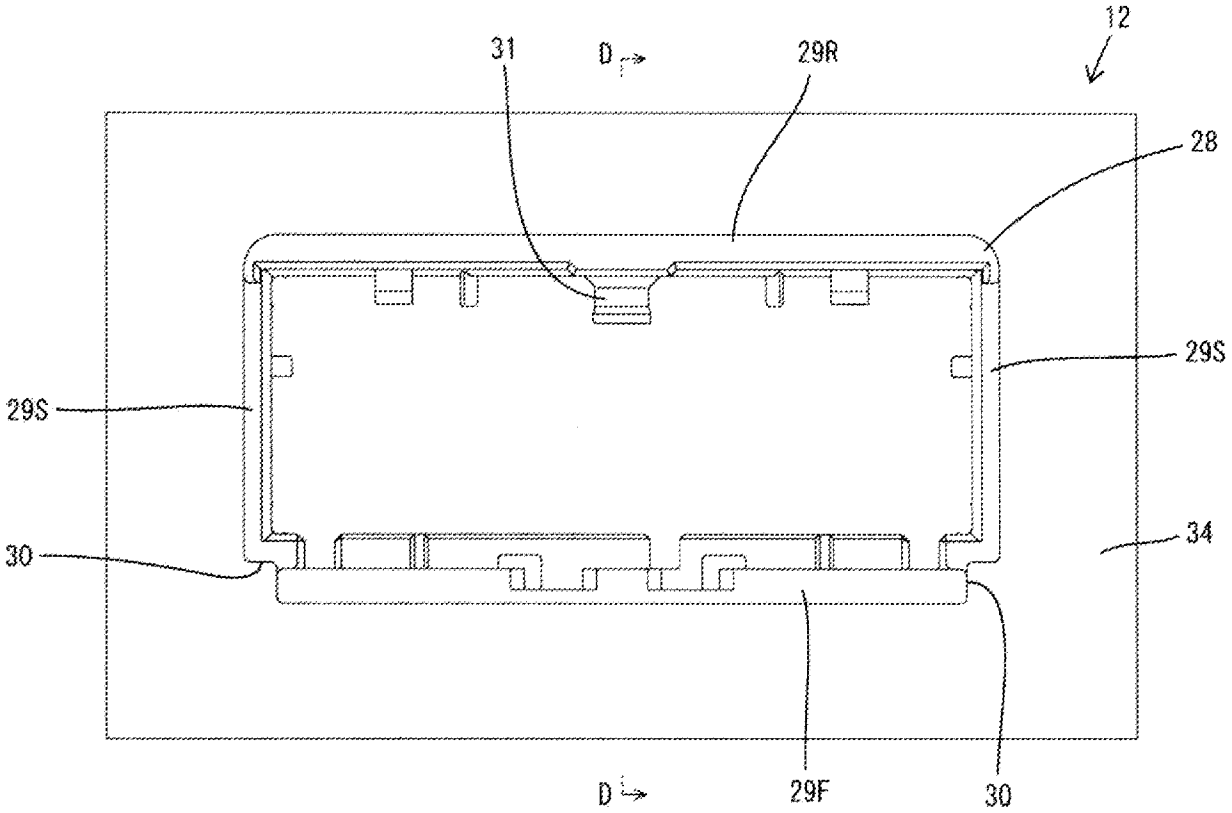
FIG. 10 is a plan view of the second molding.
Figure 11:
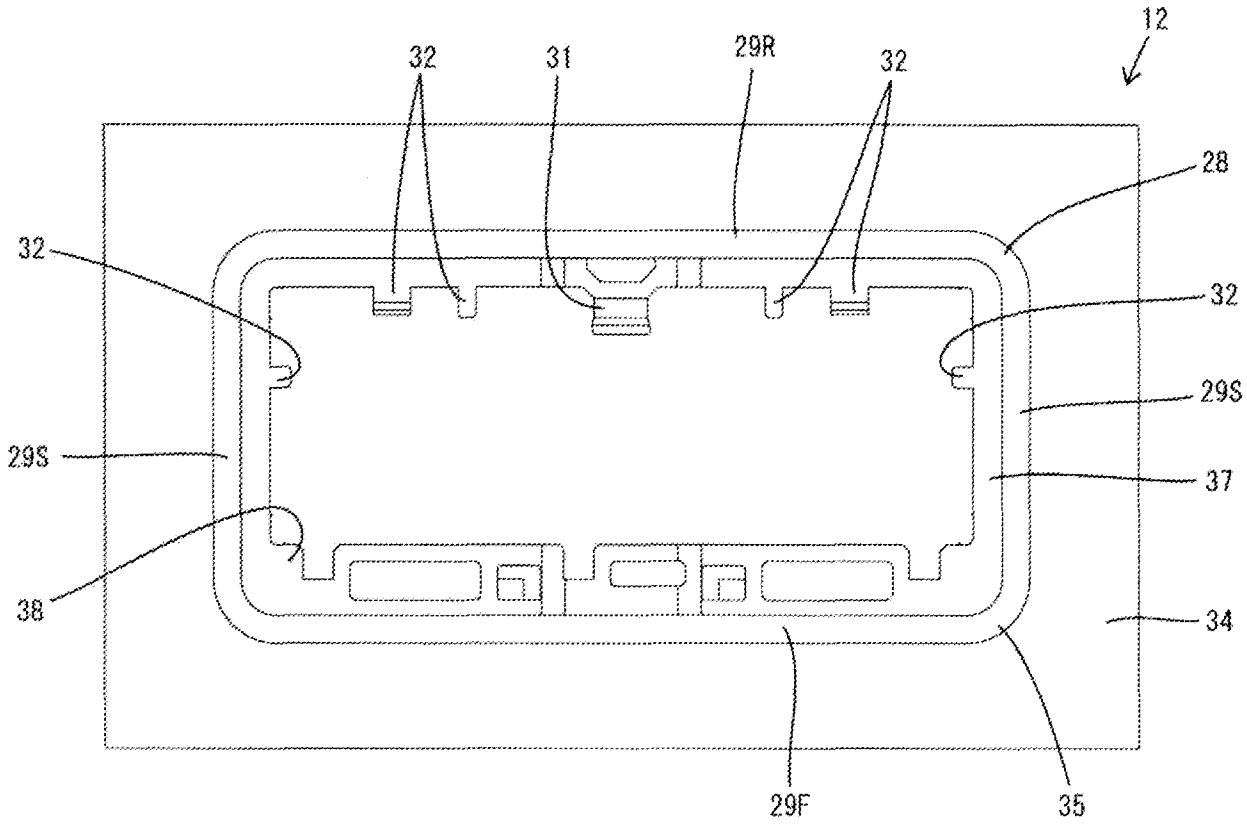
FIG. 11 is a bottom view of the second molding.
Figure 12:
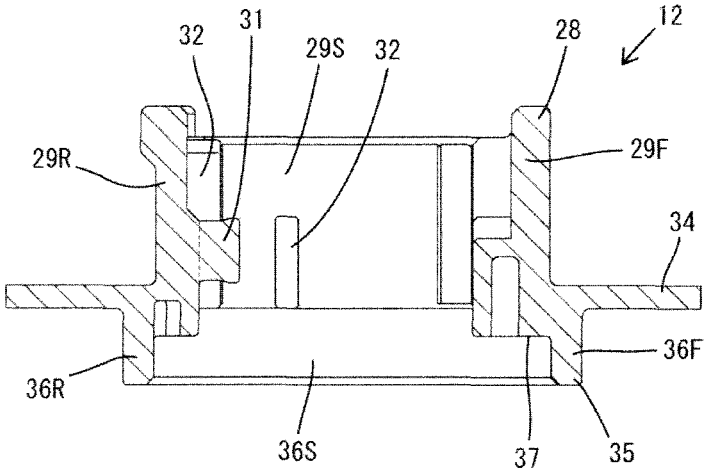
FIG. 12 is a section along D-D of FIG. 10

Hereinafter, one specific embodiment of the present invention is described with reference to FIGS. 1 to 12. In this embodiment, upper and lower sides appearing in FIGS. 3, 4, 8 and 12 are defined to be upper and lower sides concerning a vertical direction. Lower sides in FIGS. 2, 6 and 10 and right sides in FIGS. 4, 8 and 12 are defined to be front sides concerning a front-back direction.

Figure 1:
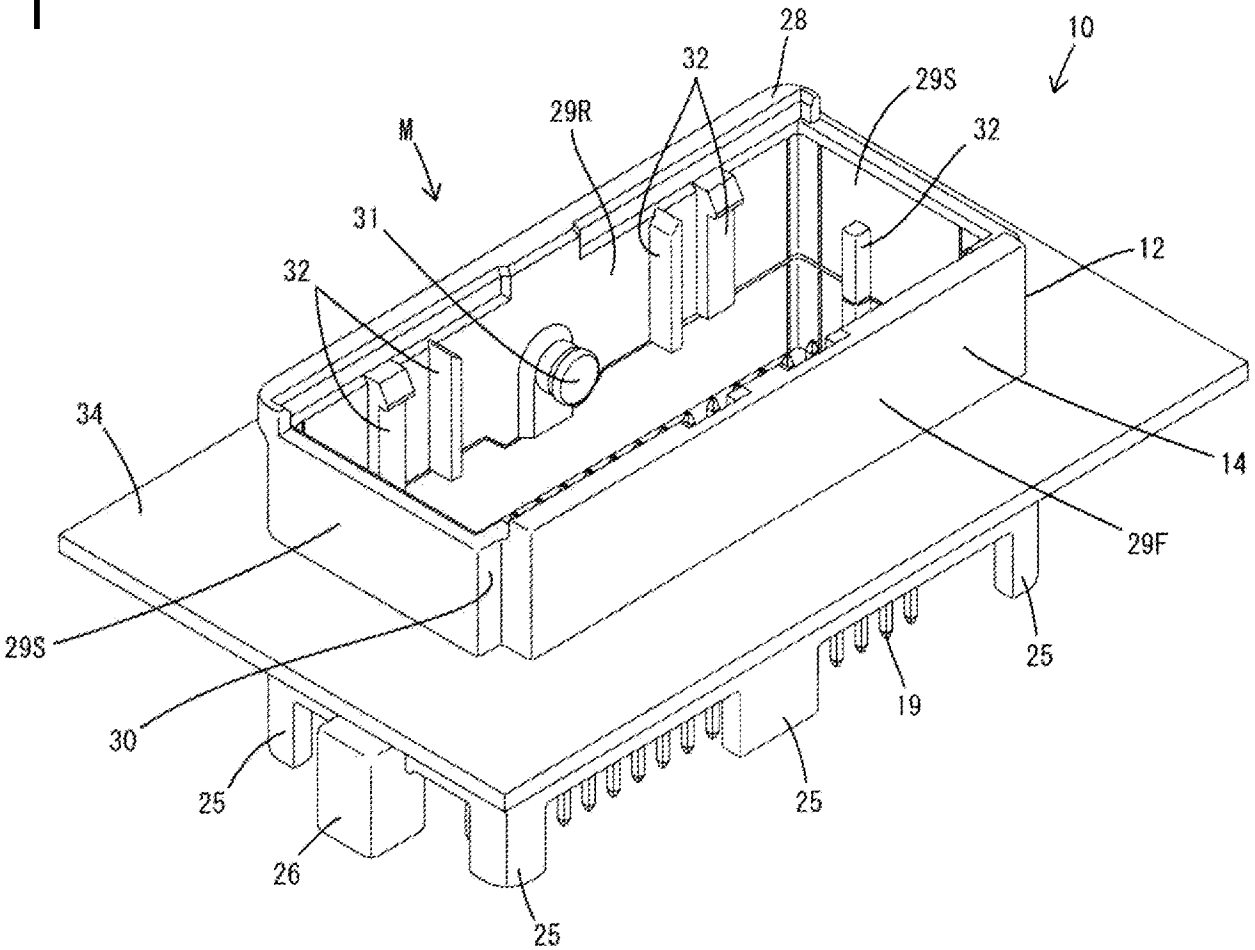
FIG. 1 is a perspective view of a board connector of an embodiment.
Figure 2:
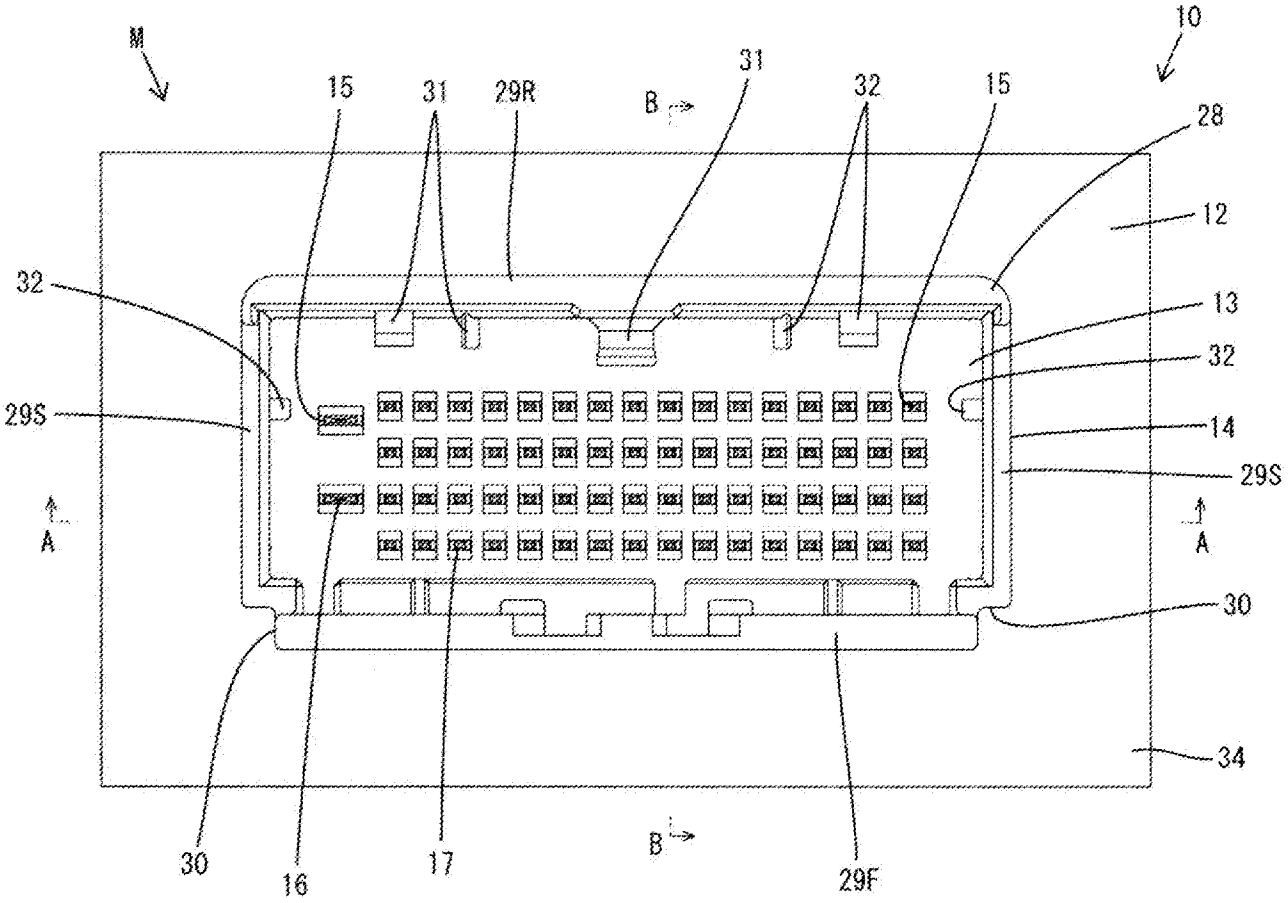
FIG. 2 is a plan view of the board connector.
Figure 3:
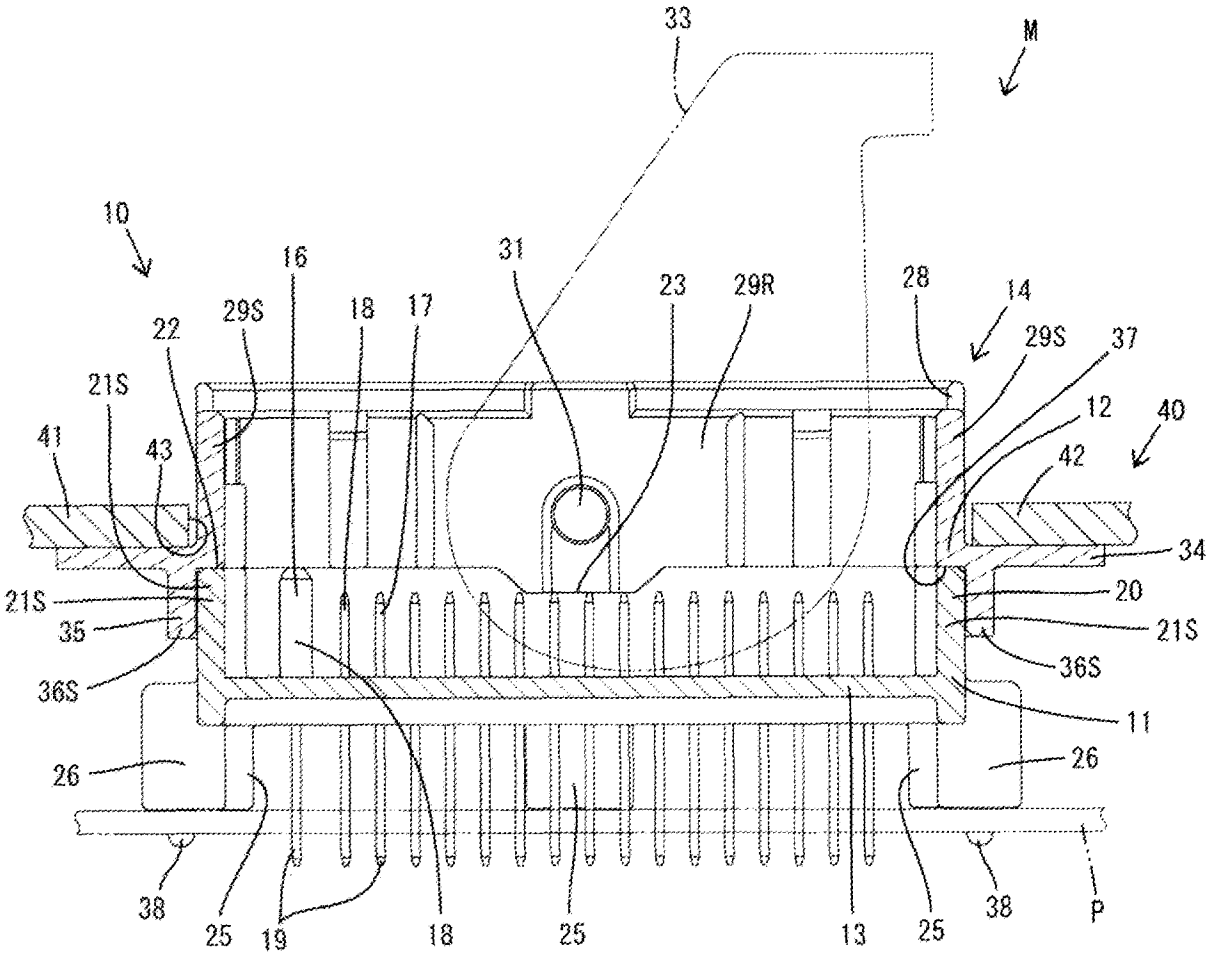
FIG. 3 is a section along A-A of FIG. 2.
Figure 4:
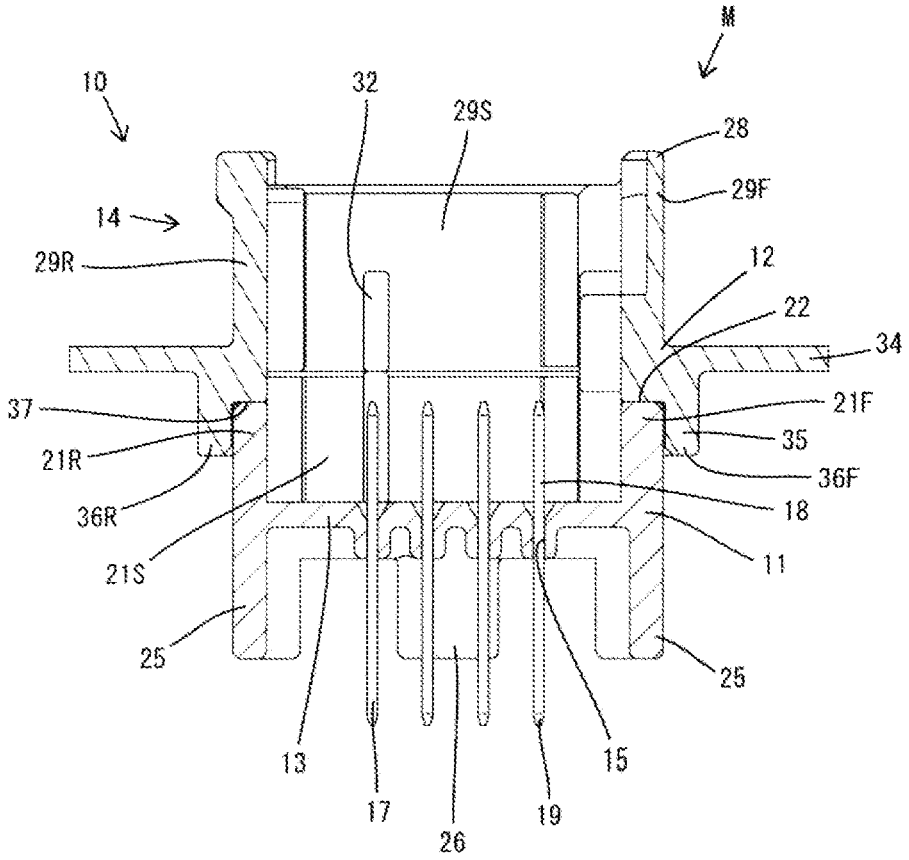
FIG. 4 is a section along B-B of FIG. 2.
Figure 5:
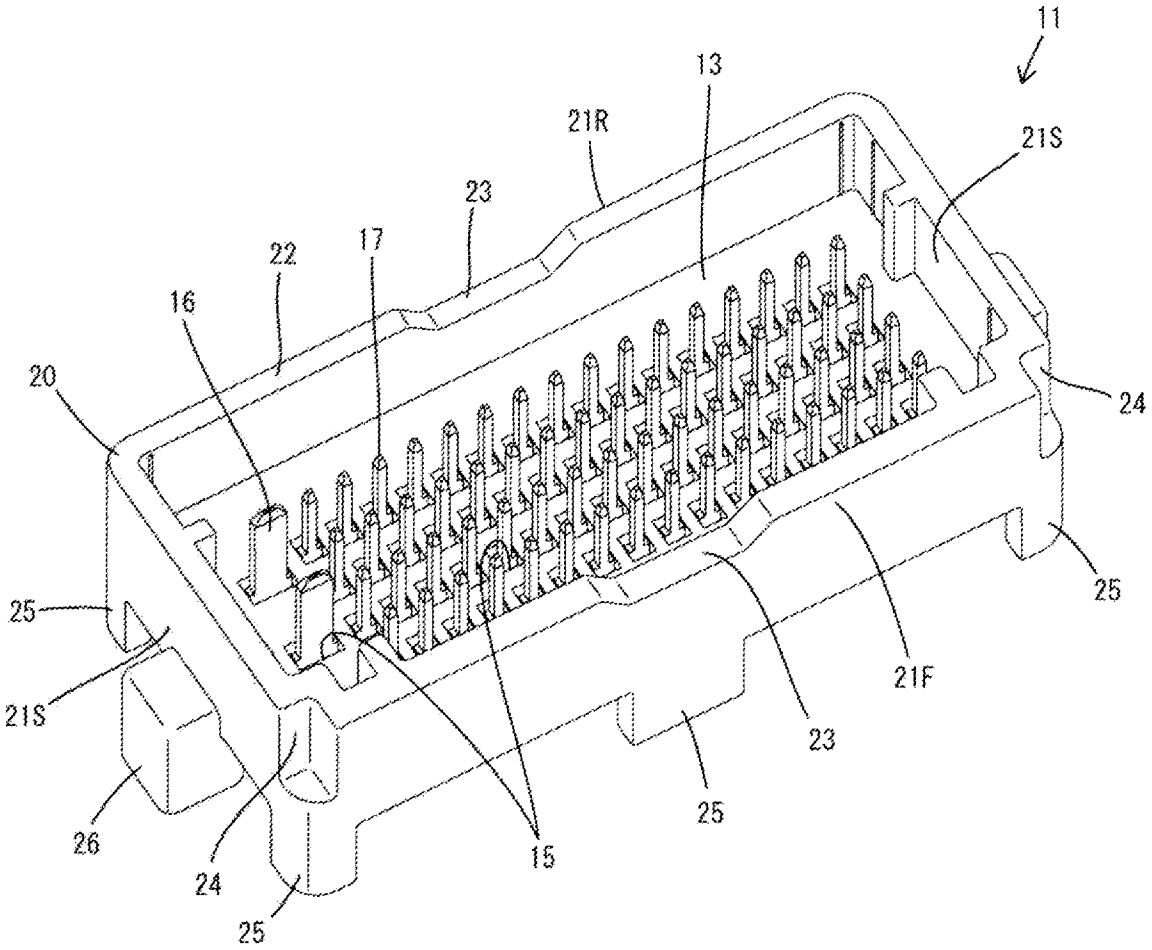
FIG. 5 is a perspective view of a first molding.
Figure 6:
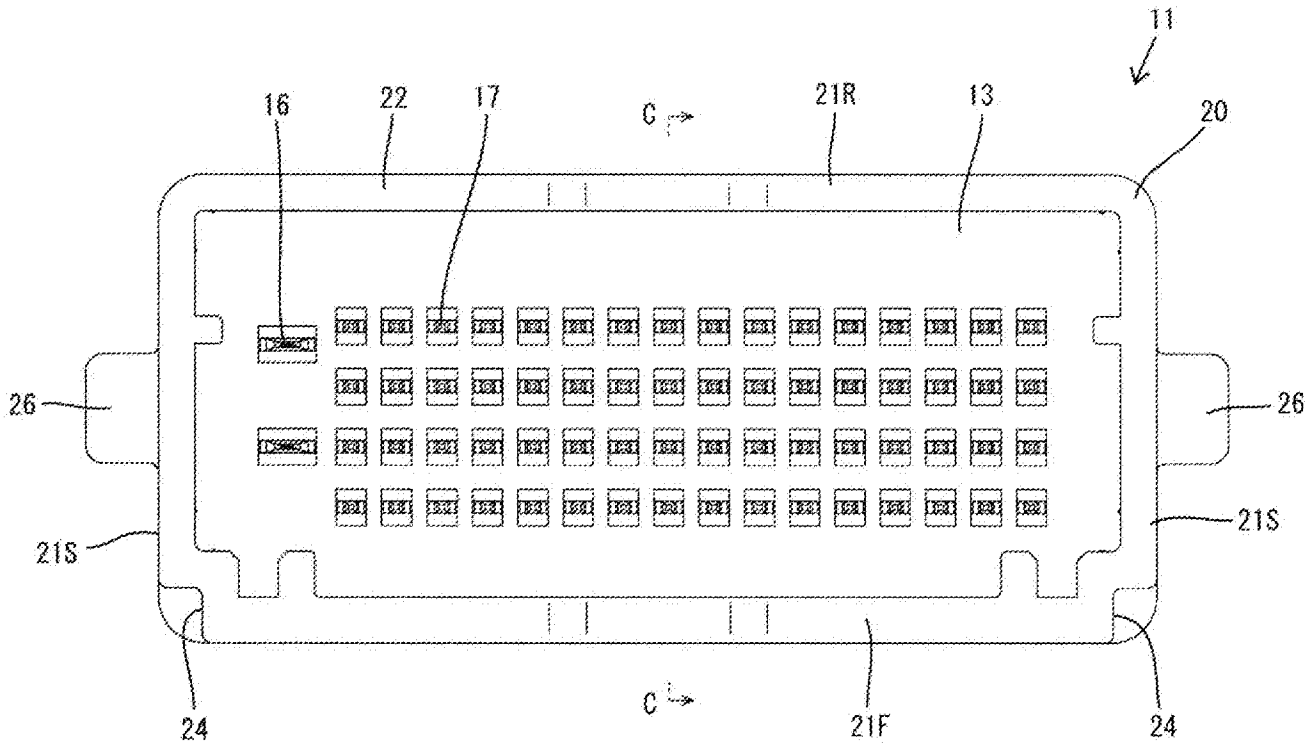
FIG. 6 is a plan view of the first molding.
Figure 7:
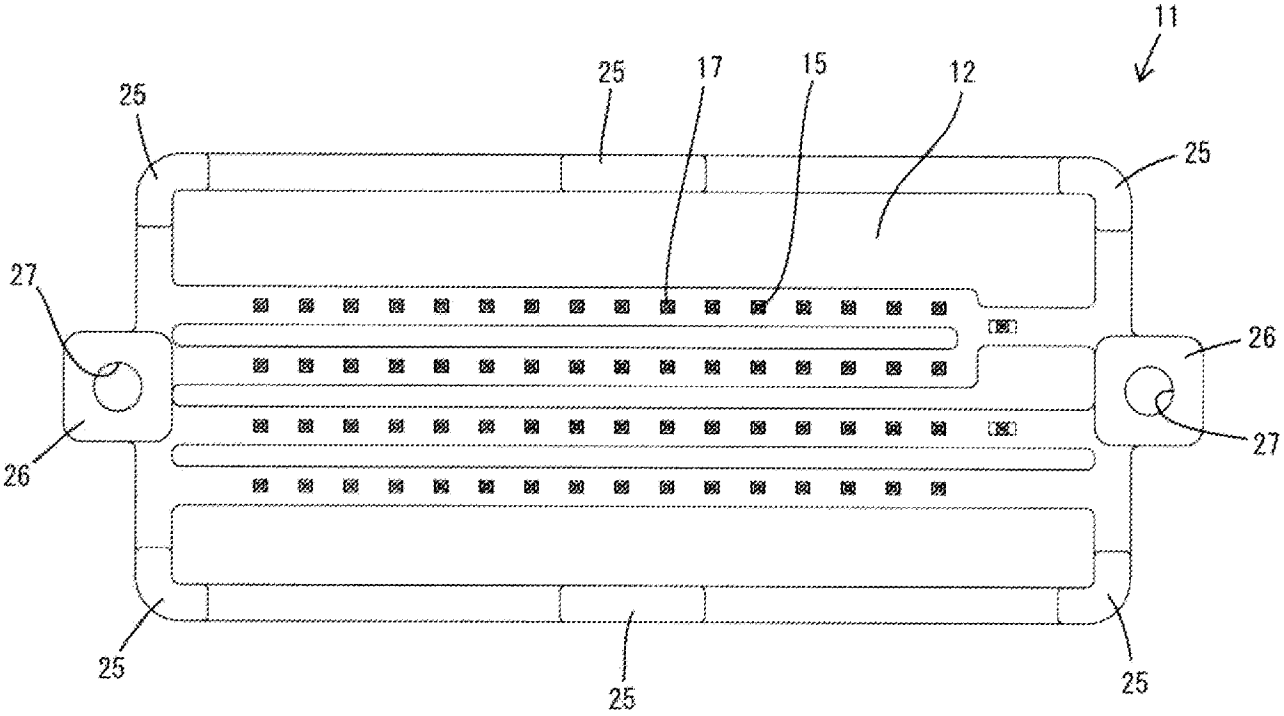
FIG. 7 is a bottom view of the first molding.

A board connector M of this embodiment is mounted on the upper surface of a circuit board P horizontally arranged in a casing 41 of a device 40 to penetrate through an upper plate 42 of the casing 41, as shown in FIG. 3. The upper plate 42 of the casing 41 is formed with a substantially rectangular opening 43 for allowing the board connector M to penetrate. The board connector M includes a housing 10, terminal fittings 16, 17 and a displaceable element (such as a lever 33).

The housing 10 is made e.g. of synthetic resin and configured by assembling two components, i.e. a first molding 11 molded by an unillustrated mold and a second molding 12 likewise molded by an unillustrated mold. The first molding 11 is a single component comprising a terminal holding portion 13, a base-end-side peripheral wall 20, six legs 25 and two board fixing portions 26. The second molding 12 is a single component comprising a tip-side peripheral wall 28, a supporting shaft 31 (protrusion as claimed), a plurality of ribs 32, a device mounting portion 34 and a tubular fitting 35

The housing 10 is configured by assembling the moldings 11, 12 and includes the terminal holding portion 13 in the form of a horizontal plate having a substantially rectangular plan view shape whose longer sides extend in a lateral direction, a receptacle 14 substantially in the form of a rectangular tube projecting up from the outer peripheral edge of the terminal holding portion 13 and the device mounting portion 34. The receptacle 14 is configured by uniting the base-end-side peripheral wall 20 and the tip-side peripheral wall 28.

The terminal holding portion 13 of the first molding 11 is formed with terminal holding holes 15 vertically in a plate thickness direction. First terminal fittings 16 or second terminal fittings 17 extend straight in the vertical direction and are press fit through the respective terminal holding holes 15. The first terminal fitting 16 is in the form of a plate and the second terminal fitting 17 is in the form of a pin. A height of the upper end (tip) of the first terminal fitting 16 from the upper surface of the terminal holding portion 13 as a reference is larger than that of the upper end (tip) of the second terminal fitting 17 from the upper surface of the terminal holding portion 13 as a reference.

Regions of the terminal fittings 16, 17 projecting up from the terminal holding portion 13 function as terminal connecting portions 18 to be connected to mating terminals (not shown) of a mating connector (not shown). Further, a lower part of the terminal fitting 16, 17 projecting down from the terminal holding portion 13 functions as a board connecting portion 19 to be inserted into a through hole (not shown) of the circuit board P and electrically conductively connected e.g. by soldering.

The base-end-side peripheral wall 20 is substantially in the form of a rectangular tube projecting up and is formed integrally over the entire periphery on the outer peripheral edge of the terminal holding portion 13. The base-end-side peripheral wall 20 has a substantially rectangular plan view shape whose longer sides extend in the lateral direction and constitutes the receptacle 14 by being united with the tip-side peripheral wall portion 28 to be described later. The base-end-side peripheral wall 20 comprises a front wall 21F, left and right side walls 21S and a rear wall 21R. The upper surface of the base-end-side peripheral wall 20 serves as a receiving surface 22.

Regions of the receiving surface 22 excluding recesses 23 in lateral centers of the front wall 21F and the rear wall 21R are located at the same height as the upper ends of the first terminal fittings 16 and are slightly higher than the upper ends of the second terminal fittings 17 when the upper surface of the terminal holding portion 13 is set as a reference. Two left and right vertical outer corner edges connected substantially at a right angle to both left and right end parts of the front wall 21F and front end parts of the both left and right side walls 21S have outer peripheral sides recessed, thereby forming positioning recesses 24. The left and right positioning recesses 24 extend in the vertical direction and are open on the upper end surface of the base-end-side peripheral wall 20.

The legs 25 project down and are formed unitarily on the outer peripheral edge of the terminal holding portion 13. The legs 25 are arranged on left and right end parts of a front of the terminal holding portion 13, substantially lateral central parts of the front of the terminal holding portion 13, both left and right end parts of a rear edge part of the terminal holding portion 13 and substantially lateral central parts of the rear edge part of the terminal holding portion 13. The board connecting portions 19 of the terminal fittings 16, 17 are located below the lower ends of the legs 25. The lower surfaces of the legs 25 are at the same height.

Left and right board fixing portions 26 project unitarily down on both left and right side edge parts of the terminal holding portion 13. The board fixing portion 26 is formed with a screw fastening hole 27 open on the lower end surface thereof. The lower surfaces of the board fixing portions 26 are at the same height as the lower surfaces of the legs 25. When the housing 10 is mounted on the circuit board P, the lower surfaces of the legs 25 and those of the board fixing portions 26 are in surface contact with the upper surface of the circuit board P.

The tip-side peripheral wall 28 of the second molding 12 has a substantially rectangular plan view shape whose longer sides extend in the lateral direction similarly to the base-end-side peripheral wall 20. The tip-side peripheral wall 28 is composed of a front surface wall 29F, a pair of left and right side surface walls 29 and a rear surface wall 29R. The upper and lower ends of the tip-side peripheral wall 28 are open.

Left and right vertical outer corner edge parts connected substantially at a right angle to both left and right ends of the front surface wall 29F and front ends of the left and right side surface walls 29S have outer peripheral sides recessed to form cut portions 30. These cut portions 30 are formed only on a front of the tip-side peripheral wall 28. Further, the positioning recesses 24 of the base-end-side peripheral wall 20 described above also are formed only on a front end. Thus, the orientations of the both peripheral walls 20, 28 can be aligned in the front-back direction in uniting the both peripheral walls 20, 28 if the positions of these cut portions 30 and the positioning recesses 24 are confirmed visually.

The supporting shaft 31 (protrusion as claimed) and the ribs 32 (protrusion as claimed) project on the inner wall surface of the tip-side peripheral wall 28. The supporting shaft 31 projects forward from the inner surface of the rear surface wall 29R and has a substantially cylindrical shape whose axis extends in the front-back direction. The lever 33 is a substantially flat plate with a thickness direction that extends in the front-back direction and is mounted rotatably on the supporting shaft 31. The lever 33 is of known form and exhibits a boosting function when the board connector M and the mating connector (not shown) are connected.

The ribs 32 extend long and narrow in the vertical direction and are formed on the inner surfaces of the left and right side surface walls 29S and the rear surface wall 29R. These ribs 32 exhibit a posture stabilizing function of preventing the board connector M and the mating connector from being in an oblique posture, an erroneous connection preventing function of preventing the mating connector from being connected in an improper orientation inverted by 180° in a plan view, and the like.

The device mounting portion 34 is a flange-like horizontal flat plate bulging over the entire periphery from a lower end part of the outer periphery of the tip-side peripheral wall 28. The device mounting portion 34 has a substantially rectangular plan view shape whose longer sides extend in the lateral direction similarly to the tip-side peripheral wall 28. This device mounting portion 34 comes into contact with the lower surface of the upper plate 42 (inner side of the casing 41) forming part of the casing 41 of the device 40.

The tubular fitting 35 is substantially in the form of a rectangular tube projecting down over the entire periphery from a lower end part of the tip-side peripheral wall 28, i.e. from an opening edge of the tip-side peripheral wall 28 on the lower surface of the device mounting portion 34. The tubular fitting 35 is composed of a front surface covering portion 36F, left and right side surface covering portions 36S and a rear surface covering portion 36R. The tubular fitting 35 is slightly larger than the tip-side peripheral wall 28. That is, in a plan view, the tubular fitting 35 and the tip-side peripheral wall 28 are in such a positional relationship that the inner peripheral surface of the tubular fitting 35 and the outer peripheral surface of the tip-side peripheral wall 28 substantially align. The lower end surface of the tip-side peripheral wall 28 defines a contact surface 37.

The tubular fitting 35 is united with the base-end-side peripheral wall 20 by being press-fit externally to the base-end-side peripheral wall 20 from above. In a united state, the front surface covering portion 36F, the left and right side surface covering portions 36S and the rear surface covering portion 36R strongly press the outer surfaces (front surfaces) of the front wall 21F, the left and right side walls 21S and the rear wall 21R while being held in surface contact therewith. Further, the contact surface 37 of the tip-side peripheral wall 28 comes into contact with the receiving surface 22 of the base-end-side peripheral wall 20.

In assembling the first and second moldings 11, 12, the terminal fittings 16, 17 are mounted in the first molding 11 in advance. At this time, since the terminal connecting portions 18 of the terminal fittings 16, 17 are surrounded by the base-end-side peripheral wall 20, there is no possibility that external matter interferes with the terminal fittings 16, 17 from outside. The housing 10 is configured when the second molding 12 is assembled with the first molding 11 from above to unite the peripheral walls 20, 28. In the united state, the tip-side peripheral wall 20 is connected above the base-end-side peripheral wall 20 and the receptacle 14 is configured. In the united state, the inner wall surfaces of the peripheral walls 20, 28 are connected while being substantially flush with each other. That is, no large step or unevenness is present on a boundary between the both peripheral wall portions 20, 28 on the inner wall surface of the receptacle 14. The device mounting portion 34 is arranged substantially at a central height of the outer periphery of the receptacle 14 in the vertical direction.

The lever 33 is mounted rotatably on the supporting shaft 31 projecting from the inner wall surface of the receptacle 14 after the moldings 11, 12 are united to complete the assembling of the board connector M. The assembled board connector M is mounted on the circuit board P. At this time, the board connecting portions 19 of the terminal fittings 16, 17 are inserted into the through holes (not shown) of the circuit board P and the board fixing portions 26 of the housing 10 are positioned and placed on the upper surface of the circuit board P. Then, screws 38 (fastening member as claimed) inserted from a lower surface side of the circuit board P are screwed into the screw fastening holes 27 of the board fixing portions 26 to fix the housing 10 to the circuit board P. Thereafter, the board connecting portions 19 of the terminal fittings 16, 17 are fixed to the circuit board P by soldering.

In the above way, the board connector M is mounted on the circuit board P. Thereafter, the circuit board P and the board connector M are fixed at a predetermined position in the casing 41 of the device 40. At this time, a region of the receptacle 14 of the board connector M above the device mounting portion 34 (tip side) is caused to project up (outwardly of the casing 41) from the opening 43 of the upper plate 42 of the casing 41 and the upper surface of the device mounting portion 34 is positioned in contact with the inner surface (lower surface) of the upper plate 42. In the above way, the mounting of the board connector M and the circuit board P in the casing 41 is completed.

As described above, the board connector M of this embodiment includes the housing 10 made e.g. of synthetic resin and to be mounted on the circuit board P, the terminal holding portion 13 constituting the housing 10, the terminal fittings 16, 17 mounted to penetrate through the terminal holding portion 13 and to be connected to the circuit board P, the receptacle 14 constituting the housing 10 and projecting forward (up) from the outer peripheral edge of the terminal holding portion 13 and the protrusions (supporting shaft 31 and ribs 32) integrally formed to the receptacle 14 and projecting from the inner wall surface of the receptacle 14. Further, the first molding 11 formed by integrating the terminal holding portion 13 and the base-end-side peripheral wall 20 as a region of the receptacle 14 closer to the terminal holding portion 13 than the protrusions, and the tubular second molding 12 being a molded article separate from the first molding and constituting the tip-side peripheral wall 28 including the protrusion out of the receptacle 14 are provided as components constituting the housing 10.

The board connector M of this embodiment is such that the first molding 11 and the second molding 12 are molded using molds in separate steps and the housing 10 is configured when the already molded moldings 11, 12 are assembled. With the moldings 11, 12 assembled, the base-end-side peripheral wall 20 and the tip-side peripheral wall 28 are united to configure the receptacle 14. The protrusions (supporting shaft 31 and/or ribs 32) projecting from the inner wall surface of the receptacle 14 are formed not on the first molding 11 including the terminal holding portion 13, but on the second molding 12 separate from the terminal holding portion 13. Thus, the terminal holding portion 13 need not be formed with mold removal holes left in molding the protrusions (supporting shafts 31 and/or ribs 32) during molding.

Further, the first and second moldings 11, 12 are connectable by being press-fit and the first molding 11 is formed with the board fixing portions 26 for fixing the first molding 11 to the circuit board P by the screws 38. According to this configuration, it is not necessary to directly fix the second molding 12 and the circuit board P. Further, the tubular fitting 35 may be provided to position the base-end-side peripheral wall 20 and the tip-side peripheral wall 28 in a united state. According to this configuration, the peripheral walls 20, 28 can be united reliably.

Further, the projecting end of the base-end-side peripheral wall 20 may be located at the same position as or more forward (up) than the tips of the terminal fittings in the projecting direction of the receptacle 14 from the upper surface (front surface) of the terminal holding portion 13 as a reference. According to this configuration, the terminal fittings can be protected from interference by external matters in a state before the base-end-side peripheral wall 20 and the tip-side peripheral wall 28 are united. Further, since the supporting shaft 31 for rotatably supporting the lever 33 for exhibiting the boosting function projects from the inner wall surface of the receptacle 14, the lever 33 can be accommodated in the receptacle 14.

The invention is not limited to the above-described embodiment. For example, the following embodiments also are included in the scope of the invention.

Although the protrusions are the supporting shaft for lever and the ribs extending in the projecting direction of the receptacle in the above embodiment, they may be other than the supporting shaft and the ribs (e.g. cam follower for booster mechanism and the like).

The device mounting portion is arranged on the lower end part (base end part) of the tip-side peripheral wall in the above embodiment. However, it may be arranged on the upper end part (tip part) or at a position between the upper and lower end parts of the tip-side peripheral wall.

Although the device mounting portion is arranged on an upper end part of an externally fitting (boundary part with the tip-side peripheral wall) in the above embodiment, it may be arranged on a lower part or at a position between the upper and lower parts of the externally fitting.

The device mounting portion is formed over the entire periphery of the tip-side peripheral wall in the above embodiment. However, it may be formed only in a partial circumferential region of the tip-side peripheral wall.

The tubular fitting is formed over the entire periphery of the tip-side peripheral wall in the above embodiment. However, it may be formed only in a partial circumferential region of the tip-side peripheral wall.

Although the terminal fittings extend straight in the above embodiment, they may be bent to be substantially L-shaped.

The second molding is assembled by being press-fit to the first molding without being directly assembled with the circuit board in the above embodiment. However, it may be fixed directly to the circuit board, such as by screwing.

The second molding is formed with the device mounting portion for mounting on the device in the above embodiment. However, the device mounting portion may be formed on the first molding.

Although the tubular fitting is formed integrally or unitarily to the second molding in the above embodiment, it may be formed integrally or unitarily to the first molding.

REFERENCE SIGNS

M . . . board connector
P . . . circuit board
10 . . . housing
11 . . . first molding
12 . . . second molding
13 . . . terminal holding portion
14 . . . receptacle
16 . . . first terminal fitting
17 . . . second terminal fitting
20 . . . base-end-side peripheral wall portion
26 . . . board fixing portion
28 . . . tip-side peripheral wall
31 . . . supporting shaft
32 . . . rib
33 . . . lever
35 . . . tubular fitting portion
38 . . . screw (fastening member)

What is claimed is:

1. A board connector, comprising:

a housing made of synthetic resin and to be mounted on a circuit board;

a terminal holding portion forming part of the housing;

at least one terminal fitting penetrating through the terminal holding portion and to be connected to the circuit board;

a receptacle forming part of the housing and projecting forward from the terminal holding portion;

at least one supporting shaft integrally formed to the receptacle and projecting from an inner wall surface of the receptacle, the supporting shaft being configured for rotatably supporting a lever for exhibiting a boosting function;

a first molding forming part of the housing and formed by integrating the terminal holding portion and a base-end-side peripheral wall as a region of the receptacle closer to the terminal holding portion than the supporting shaft; and a tubular second molding forming part of the housing, being a molded article separate from the first molding and forming part of a tip-side peripheral wall including the supporting shaft.

2. The board connector of claim 1, wherein a projecting end of the base-end-side peripheral wall is located at substantially the same position as or more forward than the tip of the terminal fitting in a projecting direction of the receptacle from the terminal holding portion.

3. The board connector of claim 1, wherein the first molding and the second molding are connectable by being press-fit together.

4. The board connector of claim 3, wherein the first molding is formed with at least one board fixing portion for fixing the first molding to the circuit board.

5. The board connector of claim 1, further comprising a tubular fitting portion configured for positioning the base-end-side peripheral wall and the tip-side peripheral wall portion in a united state.

6. A method for forming a board connector, comprising:

molding a first molding having a front end, a rear end, a terminal holding portion between the front and rear ends and a forwardly open base-end-side peripheral wall projecting forward from the terminal holding portion to the front end;

molding a second molding having a tubular tip-side peripheral wall including open front and rear ends and at least one protrusion projecting in from the tip-side peripheral wall at one or more positions between the front and rear ends of the peripheral wall;

telescoping the rear end of the tubular peripheral wall of the second molding over the front end of the first molding forward of the terminal holding portion to form a forwardly open receptacle extending forward from the terminal holding portion beyond the front end of the first molding and to the front end of the peripheral wall of the second molding, with the at least one protrusion projecting into the receptacle at a position between the terminal holding portion and the front end of the peripheral wall of the second molding.

7. A board connector housing made of synthetic resin and to be mounted on a circuit board, the board connector housing comprising:

a terminal holding plate extending substantially parallel to the circuit board, the terminal holding plate being formed with terminal holding holes extending therethrough and configured to accommodate terminal fittings to be connected to the circuit board;

a forwardly open base-end-side peripheral wall unitary with the terminal holding plate and projecting forward from the terminal holding plate; and a tubular fitting molded separately from the forwardly open base-end-side peripheral wall and having open front and rear ends, the rear end of the tubular fitting being telescoped into engagement with a front end of the forwardly open base-end-side peripheral wall, the front end of the tubular fitting defining a front end of the board connector housing, a receptacle being defined by the base-end side peripheral wall and the tubular fitting, and at least one protrusion formed integrally with the tubular fitting and projecting into the receptacle at a position spaced from the terminal holding plate.

8. The board connector housing of claim 7, wherein the rear end of the tubular fitting is press-fit into telescoped into engagement with the front end of the forwardly open base-end-side peripheral wall.

9. The board connector housing of claim 7, further comprising at least one board fixing portion projecting unitarily rearward from the terminal holding plate for fixing the board connector housing to the circuit board.

10. The board connector housing of claim 7, wherein the protrusion is a cam follower of a booster mechanism.

* * * * *